US005766419A

United States Patent [19]

Linsuri et al.

[11] Patent Number: 5,766,419

[45] Date of Patent: Jun. 16, 1998

[54] TWIN-WIRE GAP FORMER IN A PAPER MACHINE

[75] Inventors: Ari Linsuri, Muurame; Lauri Verkasalo, Jyväskylä, both of Finland

[73] Assignee: Valmet Corporation, Helsinki, Finland

[21] Appl. No.: 685,232

[22] Filed: Jul. 23, 1996

[51] Int. Cl.[6] ..... D21F 1/00

[52] U.S. Cl. ..... 162/301; 162/300; 162/315; 162/317; 162/351

[58] Field of Search ..... 162/315, 317, 162/318, 300, 301, 351

[56] References Cited

U.S. PATENT DOCUMENTS

| | | | |
|---|---|---|---|
| 3,455,780 | 7/1969 | Hazard, Jr. et al. | 162/214 |
| 3,582,467 | 6/1971 | Gustafson et al. | 162/303 |
| 3,810,818 | 5/1974 | Arledter | 162/301 |
| 3,823,062 | 7/1974 | Ward et al. | 162/301 |
| 3,823,064 | 7/1974 | Ward | 162/301 |
| 3,944,464 | 3/1976 | Means | 162/273 |
| 4,028,175 | 6/1977 | Schiel | 162/301 |
| 4,141,788 | 2/1979 | Justus | 162/125 |
| 4,234,382 | 11/1980 | Schiel | 162/301 |
| 4,895,623 | 1/1990 | Corbellini | 162/301 |
| 5,160,583 | 11/1992 | Eaton et al. | 162/301 |
| 5,211,814 | 5/1993 | Jaakkola et al. | 162/301 |
| 5,242,547 | 9/1993 | Corbellini et al. | 162/352 |
| 5,480,520 | 1/1996 | Esslinger | 162/352 |

FOREIGN PATENT DOCUMENTS

| | | | |
|---|---|---|---|
| 0488058 | 6/1992 | European Pat. Off. . | |
| 83102 | 1/1987 | Finland . | |
| 875196 | 5/1989 | Finland . | |
| 88089 | 8/1989 | Finland . | |
| 485 184 | 12/1975 | U.S.S.R. | 162/301 |

*Primary Examiner*—Karen M. Hastings

*Attorney, Agent, or Firm*—Steinberg, Raskin & Davidson, P.C.

[57] ABSTRACT

A twin-wire gap former in a paper machine in which an outer wire and an inner wire are guided by guide rolls and by web forming members. The wires form a twin-wire zone which starts from a forming gap into which a slice part of a headbox feeds a stock suspension jet. The forming gap is followed by a curved portion of the twin-wire zone which is guided by a first forming roll placed inside the loop of one of the wires. The forming-gap arrangement includes two opposite tip plates which define a slice channel between them. The lip plates extend deep into the forming gap so that the free ends of the lip plates are placed in direct vicinity of the forming wires or in contact with the wires. On the curve sector of the twin-wire zone, which starts after the forming gap and which is guided by the first forming roll, inside the loop of one of the wires, a water drainage box is provided, at which box the edges of the sides that are placed against the inner face to the wire are substantially sealed. The water drainage box is connected to devices which regulate the pressure/pressures in the space or spaces placed in the interior of the box and are filled with water. Then, the drainage of water is controlled both in the forming gap and on the curve sector following after the forming gap.

22 Claims, 6 Drawing Sheets

TWIN-WIRE GAP FORMER IN A PAPER MACHINE

FIELD OF THE INVENTION

The present invention relates to a twin-wire gap former in a paper machine comprising an outer wire and an inner wire which are guided by guide rolls and web forming members to form a twin-wire zone therebetween. The twin-wire zone starts from a forming gap defined by a convergence of the wires toward one another into which a slice part of a headbox feeds a stock suspension jet. The forming gap is substantially directly followed by a curved portion of the twin-wire zone which is provided with its curved form by a first forming roll placed inside a loop of one of the wires.

BACKGROUND OF THE INVENTION

In prior art gap formers in paper machines, a stock suspension jet is fed into a wedge-shaped narrowing gap between the forming wires. In several prior art gap formers, the stock suspension jet is directed at an unsupported "outer" wire at a certain impingement angle. The live stock suspension jet produces instability and in particular cross-direction wrinkles, wave formation and vanes in the unsupported wire, in particular in the lateral areas of the wire. The tendency of wrinkles and the formation of waves in the wire produce a variation in the grammage of the finished paper or board produced from the web both in the machine direction and in the cross-machine direction.

In other prior art gap formers, typically either two opposed forming rolls are used, which operate as breast rolls and are placed inside the loops of each of the wires, or alternatively in the gap area, one forming roll is used, which is placed inside the loop of one of the wires, whereas the other wire is passed into contact with the forming roll by means of guide rolls.

In so-called roll gap formers, with which the present invention is expressly concerned, in the gap area, a forming roll is placed inside the loop of the outer or inner wire and the twin-wire zone is curved over the forming roll a certain curve sector. The use of this curve sector is advantageous both in view of the web forming and in view of the guidance of the wires, because the curve sector and the tensioning pressures effective on it and arising from the tension of the wires stabilize the running of the wires and, for their part, prevent formation of detrimental wrinkles in the wires. For these reasons, and those set forth below, as the starting point of the present invention, expressly a roll gap former has been adopted, which is developed further in the present invention. The use of other gap formers with the teachings of the invention are not precluded though.

Owing to the breast and forming rolls of large diameters and owing to the guide rolls, the geometry of the forming gap usually becomes such that it is difficult to place the slice opening of the slice part of the headbox sufficiently deep in the forming gap, for example, because the devices for regulation of the profile bar of the slice opening require a considerably large space and hinder penetration of the slice part into the forming gap. These problems are emphasized in particular in multi-layer headboxes.

In gap formers, the flight distance of the stock suspension jet departing from the headbox, also referred to as the free jet length, is a critical factor in many respects. A relatively long flight distance of the jet subjects the jet to air currents in the forming gap, in which case the point of impingement of the jet may be changed and/or the surface of the jet may disintegrate while deteriorating the formation and possibly also other properties of the paper. A long flight distance of the jet, when no turbulence arising from differences in speed produced by walls is present, increases re-flocculation of the fibers detrimentally. Since, in gap formers and in particular in roll gap formers, the rolls placed in the vicinity of the headbox limit the positioning of the headbox near the gap, even in the best case the shortest flight distance of the stock jet is, in the prior art forming gap arrangements most commonly used, at least about 150 mm. In constructions developed by a number of different manufacturers of paper machines, attempts have been made to make the flight distance of the slice jet shorter by means of various "turning bar" constructions, in which case the wire can be made to run closer to the starting point of the jet.

From the current assignee's Finnish Patent Application No. 905896 (filed Nov. 29, 1990) and from the corresponding published EP Patent Application No. 0 488 058, a forming gap arrangement is known. This forming gap arrangement comprises two opposite support members whose inner sides are arranged as direct extensions of the inner sides of the lip walls that define the slice channel. The support members are arranged to extend into the forming gap substantially parallel to one another so that the free ends of the support members are placed in the direct vicinity of (proximate to), or in contact with, the forming wires. The support members are made of a plate-like material which is, at least to some extent, resilient.

Forming gap arrangements similar or corresponding to that described above have also been described in U.S. Pat. Nos. 3,582,467, 3,810,818, 3,823,064, 3,944,464, 4,141,788, and 5,160,583 as well as in Finnish Patent Application Nos. 875196 and 880809 filed in the name of Messrs. Oy Tampella Ab.

The formers and equivalent constructions described in the above-mentioned publications require development and refinement, which has been mentioned above and will be described later, and which has provided the justification for the present invention.

With constantly increasing running speeds of paper machines, ever higher requirements are imposed on the control of the stock suspension jet discharged from the headbox into the forming gap and on the control of the initial stage of the drainage of water. In respect of the control of the discharge jet, one of the starting points of the present invention is the prior art support member or foil extension arrangements known from F1 Patent Application No. 905896 and from the corresponding published EP Patent Application No. 0 488 058, by whose means, however, all problems cannot be solved and the objectives of the present invention cannot be achieved.

The present invention expressly concerns roll gap formers, with respect to which, as one example, reference is made to the current assignee's Finnish Patent No. 83,102. In this patent, advantageous features of roll gap formers are described, which features are also retained in the present invention. This prior art former and other, corresponding formers have required further development in particular in connection with the curved twin-wire zone placed on the first forming roll directly after the forming gap, in particular with respect to the controllability of the drainage/dewatering of water thereat. In the twin-wire zone, drainage of water takes place through both wires, and to a certain extent also towards the forming roll placed at the side of the inside curve if a forming roll that has an open face and that is in particular provided with suction is used as the forming roll.

By means of the suction, it is possible to some extent to regulate the drainage/dewatering of water through the outer or inner wire towards the forming roll. However, for the control of the drainage of water taking place outwards through the outer wire, no efficient means have been available, because the only parameter of control has remained the use of the tension of the outer wire and the tensioning pressure arising from the tension as a control parameter. However, for other reasons, partly in consideration of the strength of the wire, it is impossible to regulate the tension of the outer wire within limits sufficiently broad in view of the controllability of the drainage of water.

By means of the drainage of water taking place in the curved twin-wire zone, the structural properties of paper, such as formation and unequalsidedness, are determined to a considerably large extent. With increasing running speeds of paper machines, the proportion of dewatering taking place through the outer wire in the curved twin-wire zone has generally become excessively high, because the dynamic forces, which also act upon the dewatering in the zone of the forming roll, are proportional to the second power of the machine speed. The dynamic forces might be lowered by increasing the diameter of the forming roll because the forces are inversely proportional to the diameter of the roll, but this would result in other problems, mainly associated with utilization of space and costs of the construction.

OBJECTS AND SUMMARY OF THE INVENTION

Accordingly, it is an object of the present invention to provide a new and improved gap former in which the disadvantages of the prior art gap formers are substantially eliminated.

It is another object of the present invention to provide a new and improved roll gap former in which both the free slice jet and the drainage of water taking place from the first forming roll outward through the outer wire can be controlled more efficiently than in the prior art.

It is also an object of the invention to provide a former by whose means it is possible to produce paper grades of an entirely new sort, because the velocity of the slice jet can be accelerated or retarded during the drainage of water and, thus, it is possible to regulate the orientation of the web in layers in a controlled manner. As is well known, by means of the ratio of the velocity of the slice jet to the speed of the wire, it is possible to affect the formation of the paper and in particular its fiber orientation.

In view of achieving the objects stated above and others, the former in accordance with the invention includes an arrangement of a forming gap which comprises two opposite lip plates which define a slice channel between them. The lip plates are arranged to extend substantially parallel to one another and penetrate deep into the forming gap so that the free ends of the lip plates are placed in the direct vicinity of the forming wires or in contact with the wires. The construction operates as well with plates. A water drainage box is situated on the curve sector of the twin-wire zone, which starts substantially directly after the forming gap and which is guided in its curve by the first forming roll positioned inside the loop of one of the wires. At the water drainage box, the sides that are placed against the inner face of the wire are substantially sealed against the wire by appropriate sealing means, and the water drainage box is connected to devices which individually regulate the pressure/pressures in the space or spaces placed in the interior of the box and which are filled with water. Thus, by controlling the water pressure in the spaces or chambers, it is possible to dewater the web by means of pressure variations. In this manner, the drainage of water is controlled both in the forming gap and on the curve sector following substantially directly after the forming gap.

In the present invention, the dewatering can be made fully controlled both in the area of the forming gap and on the curve sector of the twin-wire zone on the first forming roll following substantially directly after the forming gap. In this curve sector, the major part of the drainage of water from the web takes place. Owing to the invention, the drainage of water can be started sufficiently gently and the dewatering pressure be increased gradually so that the retention becomes good. It is an important feature in the operation of the former in accordance with the invention that the drainage of water does not start before the drainage box placed at the side of the outside curve on the curve sector of the twin-wire zone, because of the lip plates employed in the invention, which plates extend up to the bottom of the forming gap or to the vicinity of the bottom and to the area of effect of the drainage box or to the vicinity of that area. Thus, the drainage of water in the twin-wire zone is all the time under reliable control.

Owing to the invention, entirely novel parameters for the control of the critical initial stage of the drainage of water become available, so that it is possible to produce paper grades of entirely new sorts.

Thus, the twin-wire gap former in a paper machine in accordance with the invention comprises first and second wires guided in respective loops by guide rolls and web forming members and having a joint run which constitutes a twin-wire forming zone, a forming gap being defined by the first and second wires at a beginning of the twin-wire zone. A stock suspension jet is fed from a slice part of a headbox into the forming gap between the first and second wires to form a web. A first forming roll is arranged inside the loop of the first wire and substantially directly after the forming gap in a web running direction. The twin-wire zone follows a curved run about a sector of the first forming roll. Two opposed elongate lip plates extend substantially parallel to one another to define a slice channel therebetween. The slice channel extends into the forming gap and is in flow communication with the slice part of the headbox. A free end of each lip plate proximate the forming gap is situated proximate or in contact with a respective one of the first and second wires. The former also includes water drainage means arranged inside the loop of the second wire in opposed relationship to at least a portion of the curved run of the twin-wire zone for draining water from the web. The water drainage means comprise means defining at least one water-filled chamber and sealing means in direct contact with an inner face of the second wire for sealing the at least one chamber. Regulation means are then coupled to each chamber for regulating the pressure of the water in that chamber to thereby control dewatering of the web in the curved run of the twin-wire zone. The means defining the chamber may comprise a front wall arranged proximate to the forming gap, one of the lip plates situated closer to the second wire extending in opposed relationship to the front wall or substantially to the vicinity of the front wall to prevent release of stock onto the second wire at a location before the at least one chamber. The water drainage means preferably comprise a water drainage box extending substantially over the entire area of the curved run of the twin-wire zone.

In one embodiment, the means defining the at least one chamber define a plurality of successively arranged chambers and the sealing means comprise cross-direction partition walls for separating the chambers from one another. In this case, the regulation means comprise a pump and a plurality of regulation valves coupled to the pump and to a respective one of the chambers such that the pressure in each of the chambers is individually controlled to thereby control the amount of water and distribution of the drainage of water taking place through the second wire.

The means defining the chamber may also comprise at least two walls each having a respective edge proximate the inner face of the second wire and the sealing means may thus comprise wear ribs fixedly connected to the wall edges and contacting the inner face of the second wire. Alternatively, the sealing means comprise wear ribs movably connected to the wall edges and contacting the inner face of the second wire. In this case, adjusting means are coupled to each of the wear ribs for adjusting a position of the wear ribs relative to the second wire. Also as an alternative, the sealing means may comprise spring-loaded wear ribs coupled to the wall edges and biased toward the inner face of the second wire.

In the following, the invention will be described in detail with reference to some exemplifying embodiments of the invention illustrated schematically in the figures in the accompanying drawing. However, the invention is by no means strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
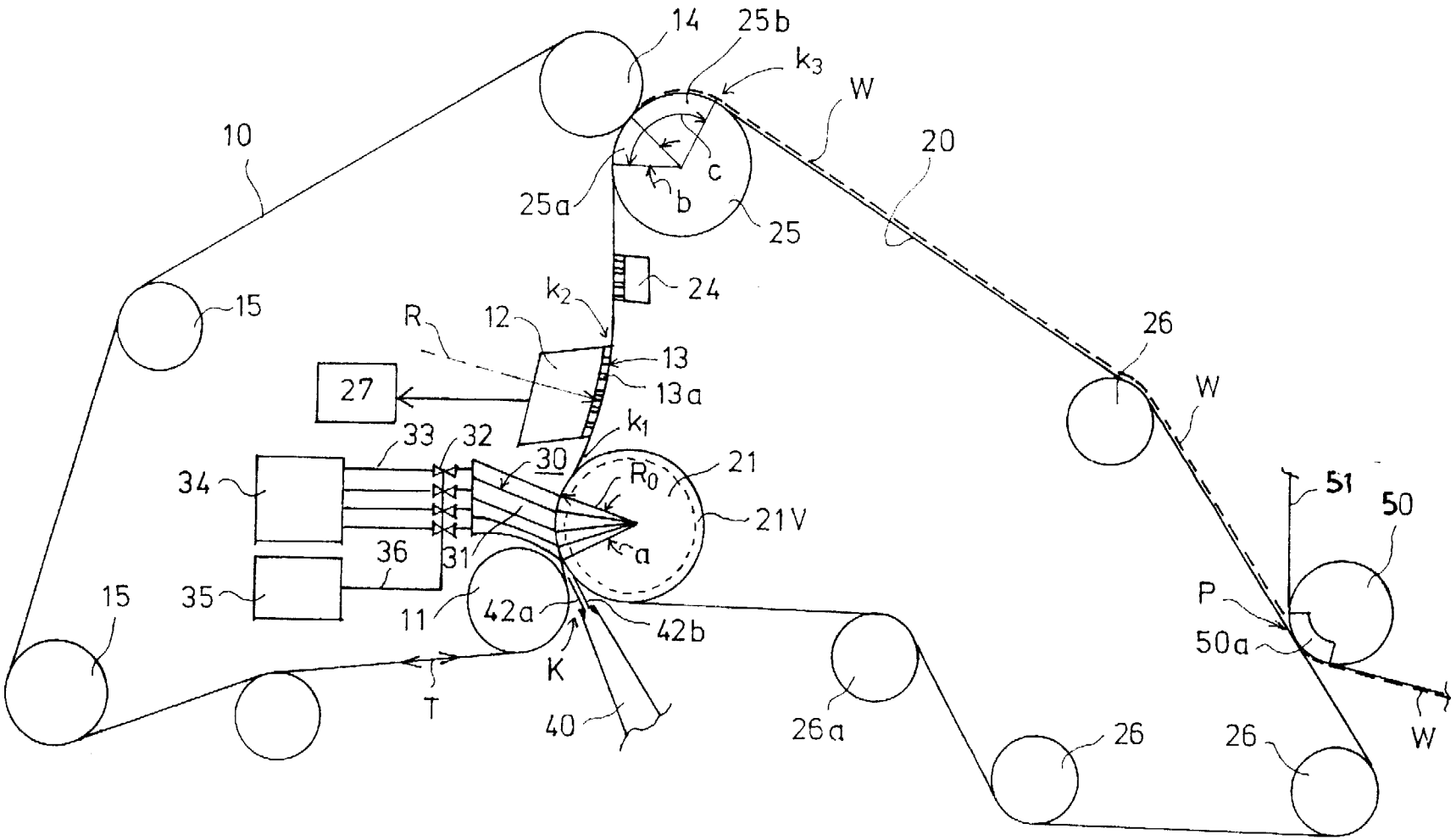
FIG. 1 is a schematic illustration of a roll gap twin-wire former as an environment of application of the present invention.

Referring to the accompanying drawings wherein the same reference numerals refer to the same or similar elements, FIG. 1 is a schematic side view of a former, as an environment of application of the present invention, which former comprises an outer wire 10 guided in a loop, an inner wire 20 guided in a loop as well as a first web forming roll 21, a second web forming roll 25 and a breast roll 11. Each of the web forming rolls 21 and 25 is placed inside the loop of the inner wire 20, and the breast roll 11 is placed inside the loop of the outer wire 10. The outer wire 10 is a so-called covering wire, and the inner wire 20 is a so-called carrying wire, i.e., the web is carried thereon after the twin-wire zone, and the web W follows the inner wire 20 after the twin-wire forming zone which ends at a location around the second forming roll 25. A headbox 40 directs a pulp stock/suspension jet into a forming gap K between the breast roll 11 and the first web forming roll 21. The headbox 40 has slice parts **42*a*,42*b* through which the stock jet of the headbox 40 is directed into the gap K defined by the wires 10 and 20. The gap K is formed as determined by the relative positions of the rolls 11 and 21, which may be movable to different configurations as needed. More particularly, the gap K is defined from one side by the inner wire 20, which is mainly guided by a guide roll 26*a* and covers the first forming roll 21, and from the other side by the outer wire 10, which is passed over the breast roll 11 onto the forming roll 21 at the beginning of its sector a to meet the inner wire 20. The stock suspension layer is thus placed between wires 10 and 20**.

According to the invention, the narrowing slice channel of the headbox 40 is followed by the plate-like lip plates **42*a* and 42*b*, which define a straight (non-narrowing or tapering) slice channel 41 having a substantially uniform width. The lip plates 42*a* and 42*b* are preferably made of a somewhat wear-resistant material, such as mesh-reinforced and/or fiber-reinforced, wear-resistant plastic. As comes out best from FIGS. 4 and 5, the lip plates 42*a* and 42*b* join the preceding slice channel 41 smoothly without steps. The lip plates 42*a* and 42*b* extend to the bottom of the forming gap K so that wedge-shaped tip portions 43*a* and 43*b* of the lip plates 42*a* and 42*b*, respectively, are placed in the direct vicinity of (proximate to) the wires 10 and 20 or in contact with the wires 10,20. Since the slice channel 41 does not become narrower any longer in the area of the lip plates 42*a*, 42*b*, the stock suspension flow F is not accelerated in the slice channel 41, at least not substantially. Thus, in the slice channel 41, the energy of the stock suspension flow is present as a static pressure. As such, it is also apparent that the speed of the stock suspension jet in the slice channel 41** is substantially constant.

In accordance with the invention, a water drainage box 30 is arranged inside the outer wire 10 in opposed relationship to the curve sector a of the twin-wire zone on the first forming roll 21, which is also referred as a curved run of the twin-wire zone. In the illustrated embodiments shown in FIGS. 1, 2 and 3, the water drainage box has been divided, directly from the bottom of the forming gap K and from the beginning of the curve sector a, into successively arranged drainage chambers **31*a*,31*b*,31*c* and 31*d*. The water drainage chambers 31 extend across the entire width of the web W up to the lateral areas of the wires 10,20. The water drainage chambers 31 are, at both sides, also provided with vertical end walls placed in the machine direction. The end walls have edges at the side of the forming roll 21 which are positioned against the inner face of the outer wire 10 and are, if necessary, provided with sealing ribs (not shown). When the former operates, the water drainage chambers 31 are completely filled with water. Each of the chambers 31 communicates with a respective water drainage duct 33, each of which is provided with a separate regulation means such as a valve 32 which regulates the water drainage pressures and water amounts in the chambers 31. By means of these valves 32, it is possible to control the pressures in the chambers 31*a*, . . . ,31*d* and thus, to control the amounts and distributions of the drainage of water on individual portions of the curve sector a of the twin-wire zone through the outer wire 10. From the side opposite in relation to the water drainage chamber 31, the valves 32 communicate through the water ducts 33 with a pump 34, which produces suitable pressures in the chambers 31***a*, . . . ,31*d* filled with water. The valves 32 are either controlled manually, and/or the valves 32 can be connected to regulation/measurement devices, which are represented in FIG. 1 schematically by the block 35 and by the regulation connection 36 passing from the block 35 to all of the regulation valves 32. The block 35 also illustrates the possible embodiment in which the regulation of the valve 32 takes place by the principle of closed feed-back connected regulation based on measurement of the properties of the web W that is being formed. In this case, the regulation control system represented by block 35 would operate to control the settings of valves 32 accordingly to correct deviations if present.

Figure 8:
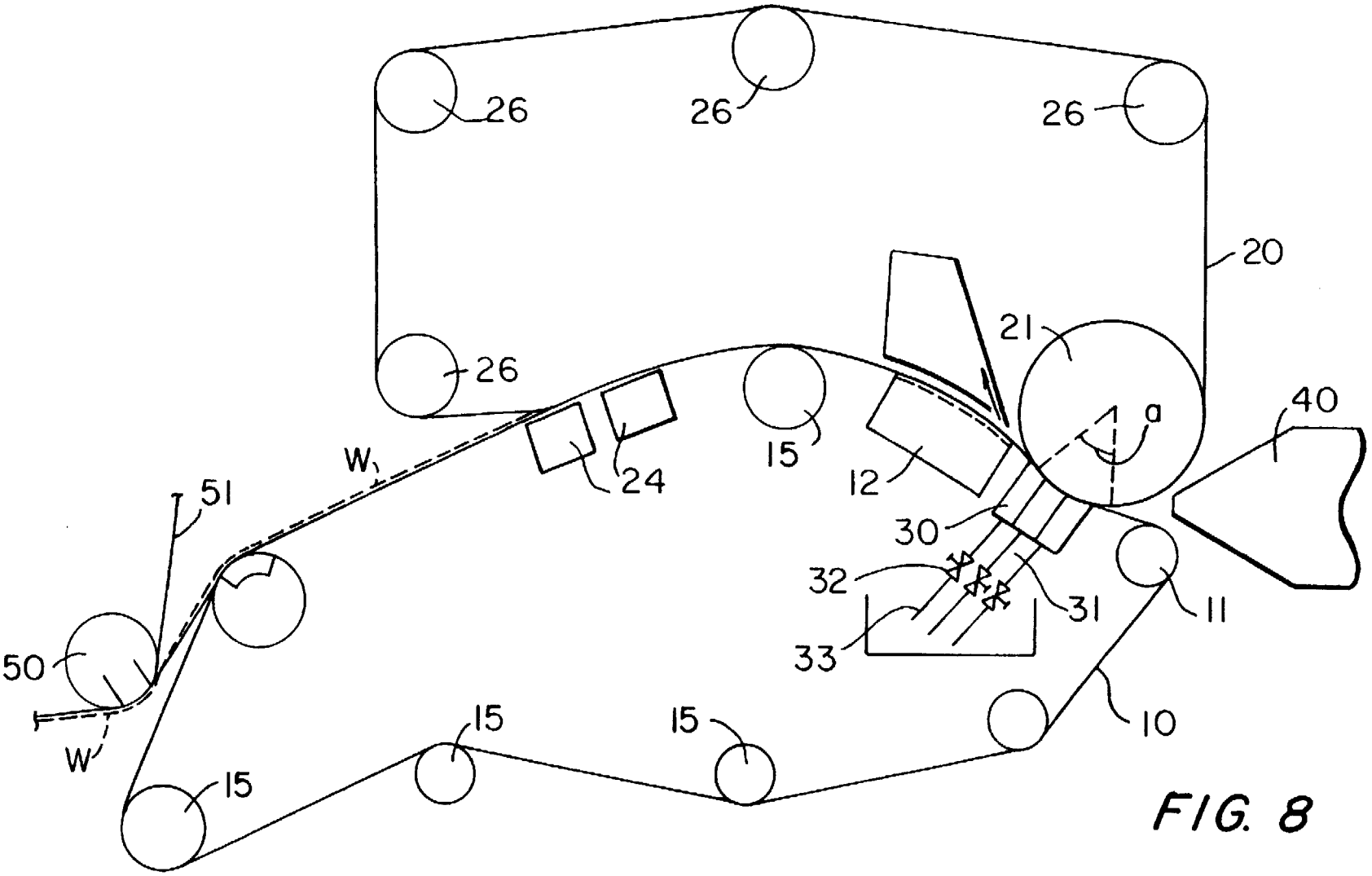
FIG. 8 shows a roll gap twin-wire former in accordance with the invention in a horizontal orientation.

Even though, in FIG. 1, as the environment of application of the invention, a former is shown in which the twin-wire zone is vertically rising from the bottom toward the top, the invention can also be applied to formers in which the twin-wire zone is substantially horizontal as shown in FIG. 8. Such a horizontal former has, for example, such a construction that, in FIG. 1, it is imagined that the vertical former therein is rotated 90° counter-clockwise, the forming roll 25 is substituted for by the guide roll of the upper wire 20, and the web W is arranged so that, after the twin-wire zone, it follows the lower wire 10, from which it is separated in a way in itself known by means of a pick-up roll. Other nonvertical, non-horizontal paths of the twin-wire zone, e.g., inclined, are also within the scope of the invention.

Additional details of the former shown in FIG. 1 will be described below.

Figure 2:
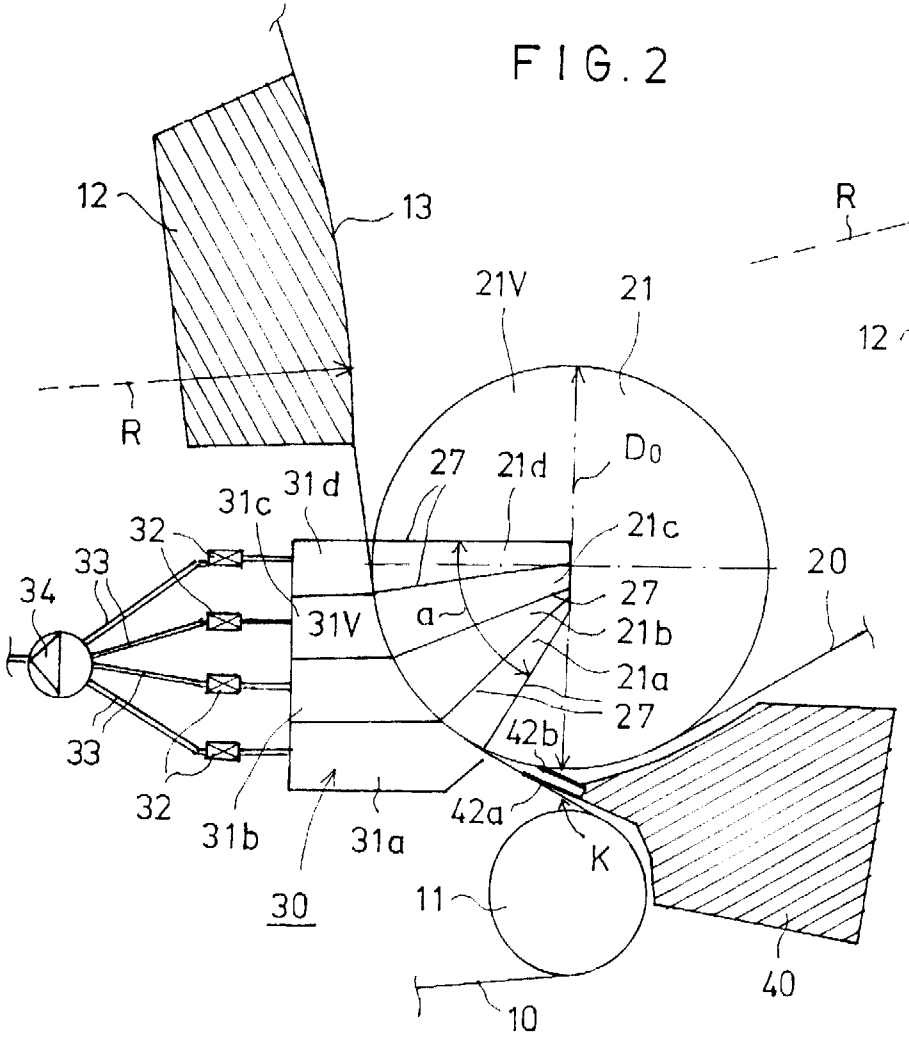
FIG. 2 shows a first exemplifying embodiment of the initial portion of the forming zone in a former in accordance with the invention.
Figure 5:
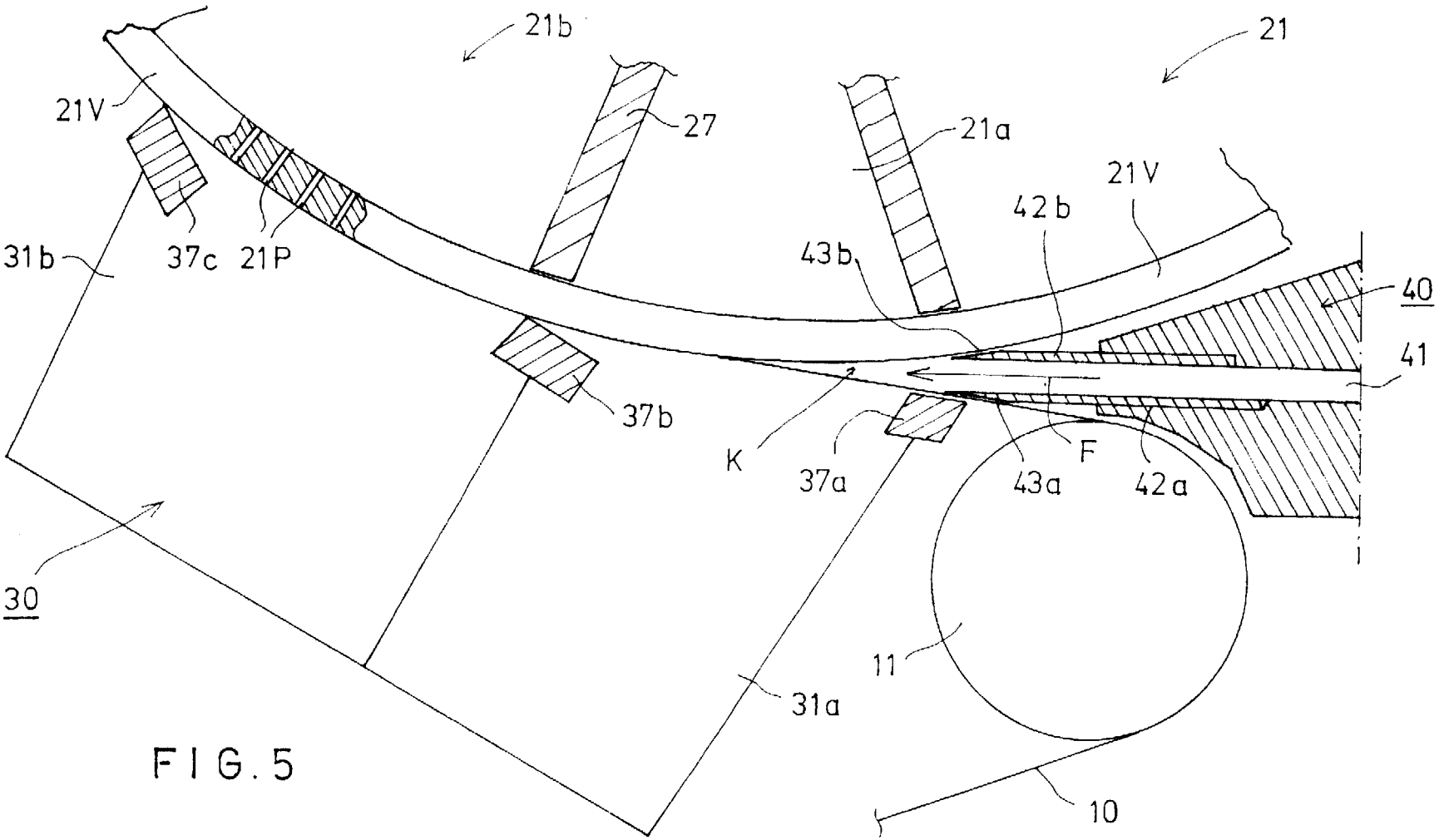
FIG. 5 shows an exemplifying embodiment of the forming gap in accordance with the invention and the subsequently arranged water drainage box arrangement in accordance with the invention.

According to FIG. 2, the first forming roll 21 is a suction roll having a revolving mantle 21 V provided with perforations 21P (seen more clearly in FIG. 5). In the interior of the mantle 21 V, fixed suction chambers 21*a*,21*b*,21*c* and 21*d* are arranged with a spacing in the machine direction corresponding to, i.e., in alignment with, a respective one of the chambers 31*a*, . . . ,31*d* in the water drainage box 30. Suction chambers 21*a*, . . . ,21*d* are separated from one another by partition walls 27. The levels of the vacuum pressure acting in the different chambers 21*a*, . . . ,21*d* can be regulated, and by means of this regulation, together with the regulation of the pressures in the water drainage chambers 31*a*, . . . ,31*d* in the water drainage box 30, it is possible to affect and accurately control the amount and the distribution of the drainage of water on the curve sector a of the twin-wire zone on the forming roll 21.

Figure 3:
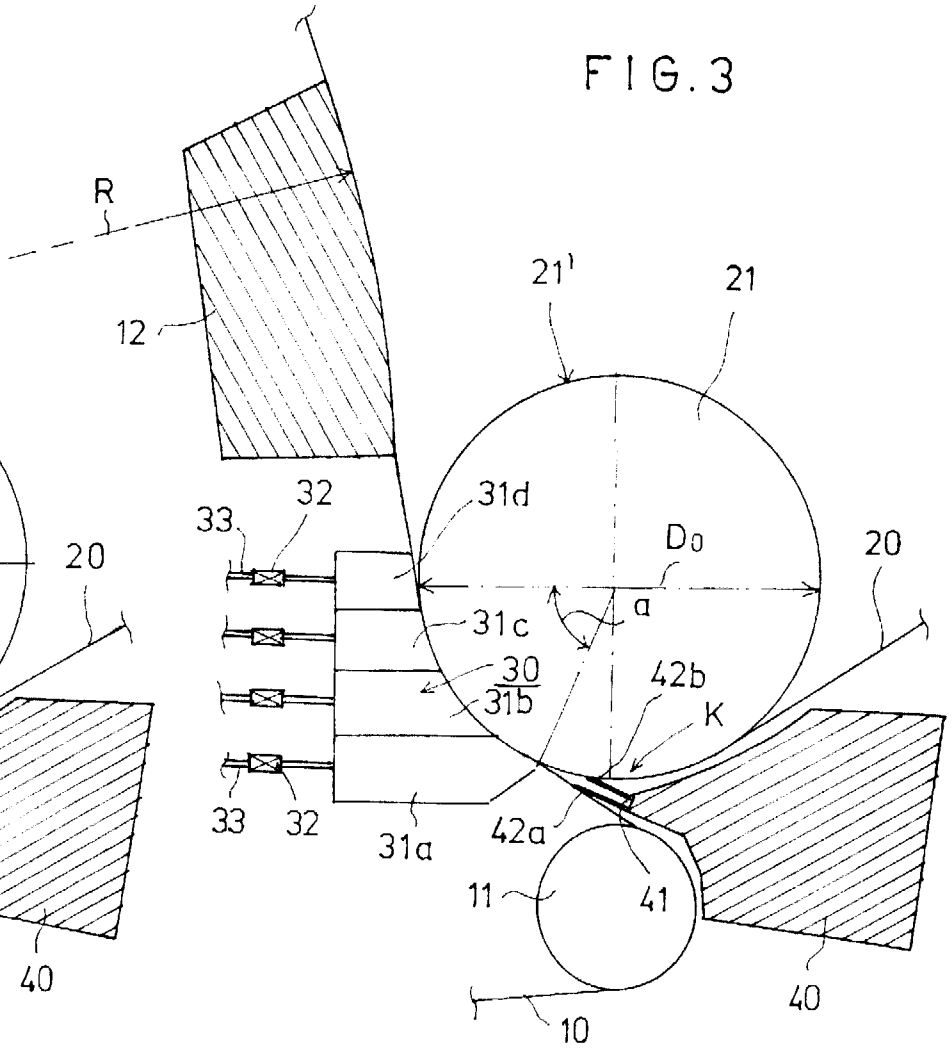
FIG. 3 shows, in a manner corresponding to FIG. 2, a second exemplifying embodiment of the invention.

In FIG. 2, instead of the first forming roll 21, as an alternative, it is possible to use a hollow-faced roll, for example a blind-drilled roll, without an inside suction chamber or even a solid-mantle forming roll 21 provided with a smooth outer face 21 shown in FIG. 3. Then on the sector a, no drainage of water takes place through the inner wire 20, but all the drainage of water on the sector a is carried out towards the water drainage box 30 through the outer wire 10. In this manner, the level and distribution of the amount of drainage of water on the sector a is regulated solely by means of the control of the pressures in the chambers 31*a*, . . . ,31*d* in the water drainage box, e.g., by means of the regulation of the valves 32 and possibly also of the pump 34.

FIGS. 2 and 3 show the number of the chambers 31*a*, . . . ,31*d* in the water drainage box 30 as four, but within the scope of the invention it is also possible to use a different number of the chambers 31, in exceptional cases, for example, just one chamber, or even more than four chambers. The pressures present in the chambers 31 are, at the minimum, equivalent to the tensioning pressure $P_T=T/R_O$ produced by the tension T of the outer wire 10, wherein $R_O$ is the radius of the first forming roll 21 ($2\ R_O=D_O$). This minimum pressure is generally of an order of from about 2 kPa to about 15 kPa. At the maximum, the pressure corresponds to the pressure in the slice channel 41 of the headbox, which is about 450 kPa. When the pressure in the chambers 31 is equal to the pressure in the slice channel 41 of the headbox, no substantial drainage of water takes place through the outer wire 10. In an exceptional case, it is also possible to use a vacuum in the chambers 31. The pressures in the chambers 31*a*, . . . ,31*d* may be staggered so that an optimal distribution of the drainage of water on the sector a is obtained. Preferably, the pressures in the chambers 31*a*, 31*b* are lowered in the direction of progress of the web W so that drainage of water is started very gently in the area of the first chamber 31 a on the sector a, and the intensity of drainage is increased stepwise in the areas of the different chambers 31*b*,31*c*,31*d* by the lowering of the pressures in the chambers 31.

As seen most clearly in FIG. 5, the lip plates 42*a*,42*b* extend to the bottom or extreme end of the forming gap K and to the front edge (defined by rib 37*a*) or to the vicinity of the front edge of the first water drainage chamber 31*a* in the water drainage box 30. For this reason, controlled drainage of water through the outer wire 10 does not start substantially until in the area of the water drainage box 30, whereby drainage of water is brought better under control by regulating the pressures in the chambers 31*a*, . . . ,31*d* filled with water. In fact, any drainage of water through the outer wire 10 is substantially prevented by this construction.

Figure 4:
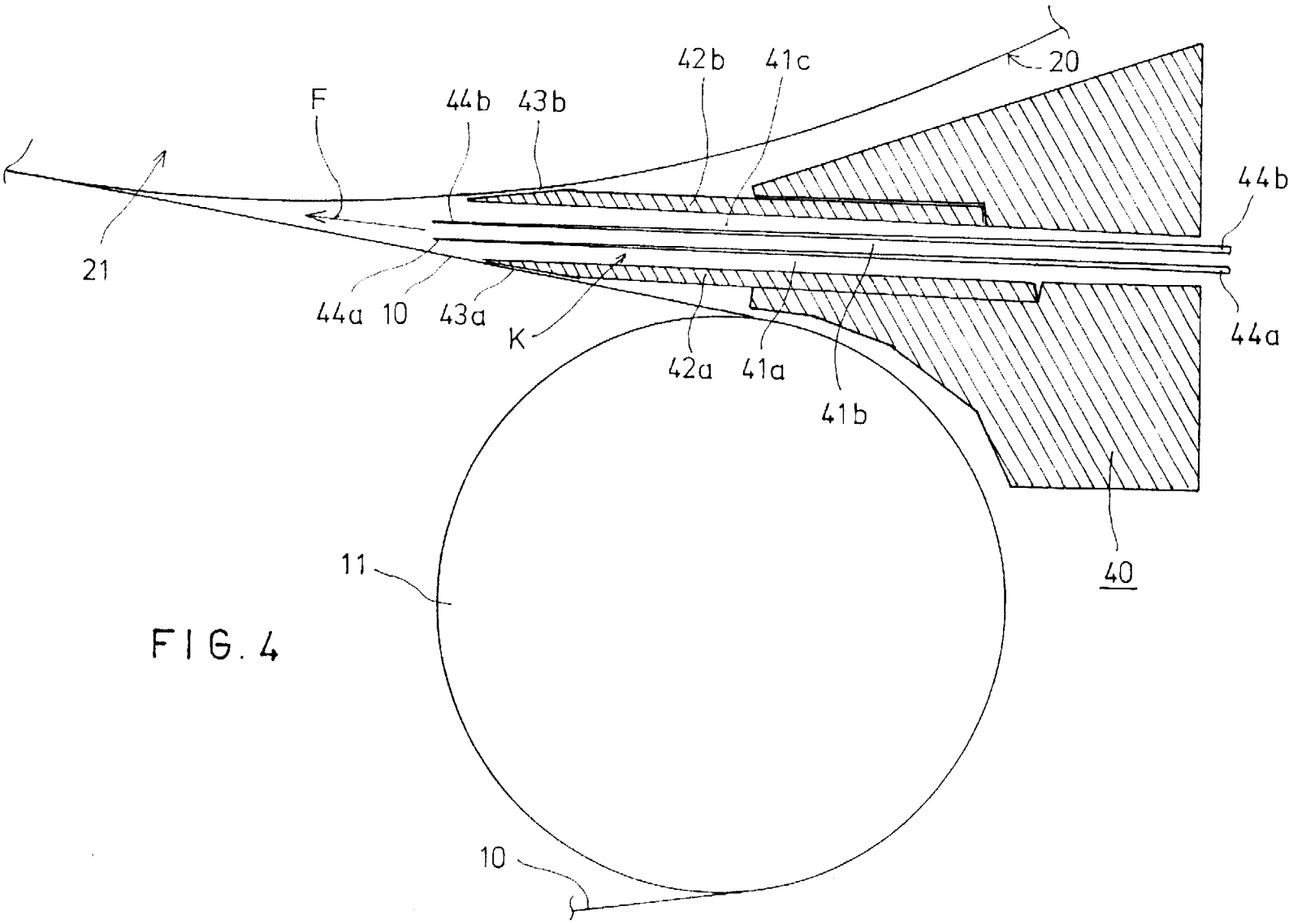
FIG. 4 shows an exemplifying embodiment of the forming gap applied in the present invention.

FIG. 4 shows a forming gap arrangement applied in the invention in which two plate-like intermediate plates 44*a* and 44*b* are arranged between the lip plates 42*a*,42*b* and spaced therefrom. The plates 42*a*,42*b*,44*a*,44*b* thus define three component ducts 41*a*,41*b*,41*c* placed one above the other between the plates 42*a*,42*b*, through which ducts the stock suspension flow F is discharged into the gap formed by the wires 10,20. In FIG. 4, the intermediate plates 44*a*,44*b* extend somewhat beyond the tips 43*a* and 43*b* of the lip plates in the flow direction F. Into the different flow ducts 41*a*,41*b*,41*c* defined at least in part by the intermediate plates 44*a*,44*b*, it is possible to pass stock of different qualities or different consistencies depending on the paper grade to be produced. This embodiment of the headbox slice part can be applied to any of the disclosed gap former constructions.

FIG. 5 shows an embodiment of the invention in which the first forming roll 21 is a suction roll, whose first suction zone 21*a* starts at the tips 43*a*,43*b* of the lip plates 42*a*,42*b*, i.e., in opposed relationship to the tip 43*b*, and the first chamber 31 a of the water drainage box 30 placed inside the outer wire 10 also starts at the same location. A ceramic sealing rib 37*a* is placed on the front wall of the chamber 31*a* and is pressed against the inner face of the outer wire 10, i.e., in opposed relationship to the tip 43*a*. Placed facing the second suction chamber 21*b* in the forming roll 21, there is the second chamber 31*b* in the water drainage box 30, ceramic sealing ribs 37*b* and 37*c* being attached to the outer edges of the walls of the chamber 31*b*. Ribs 37*b* and 37*c* are placed against the inner face of the outer wire 10.

Figure 7:
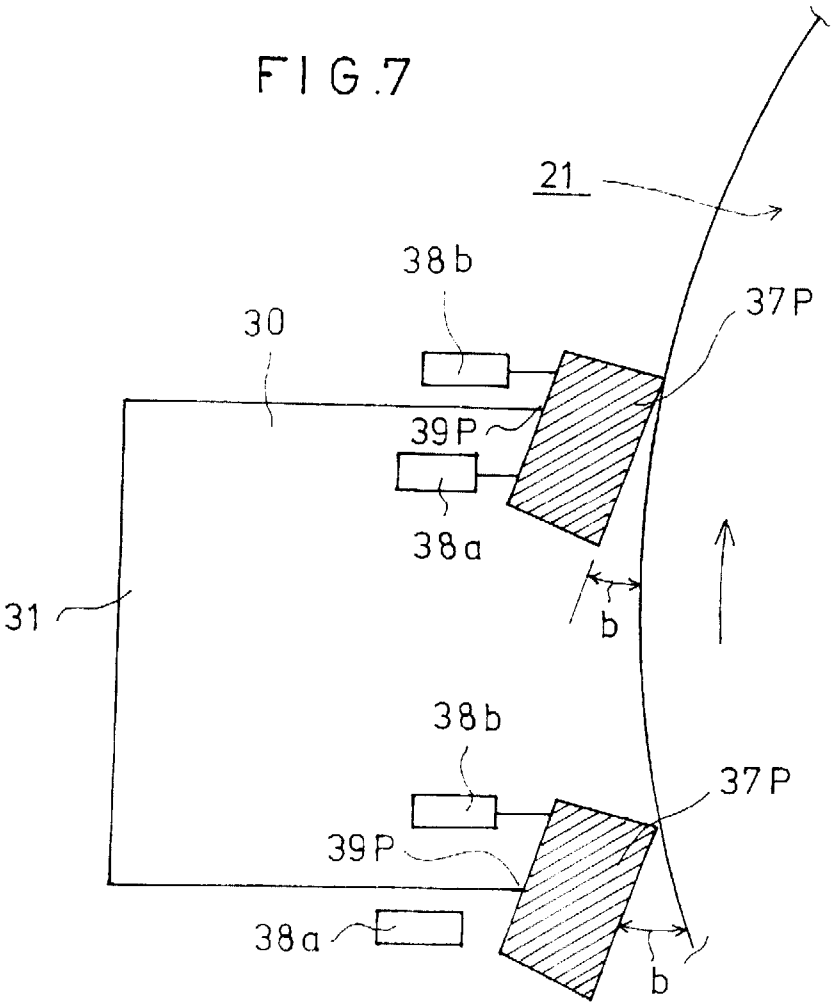
FIG. 7 shows, in a manner corresponding to FIG. 6, an alternative arrangement of loading/relief of sealing ribs.
Figure 6:
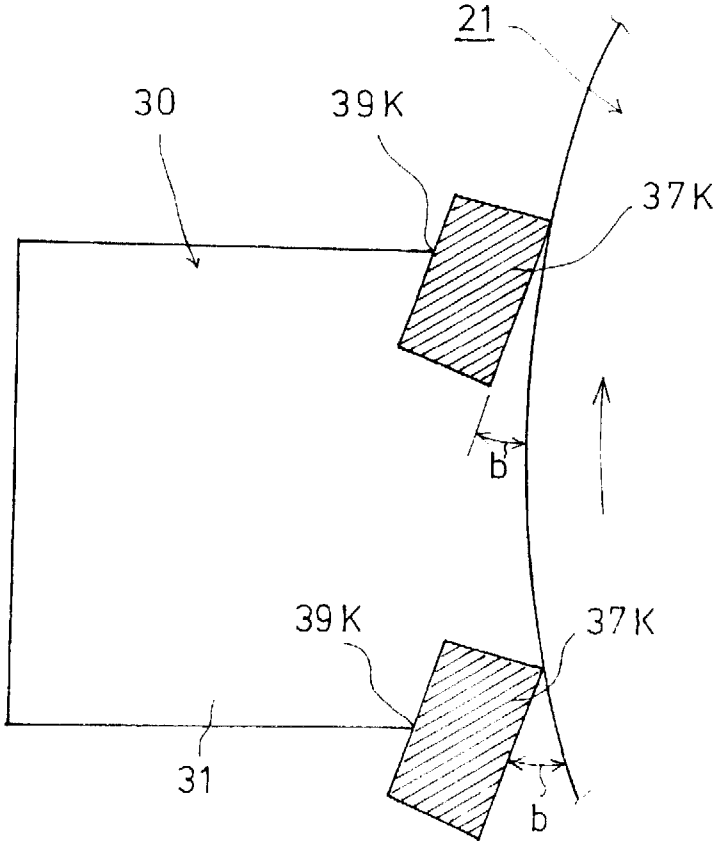
FIG. 6 shows an exemplifying embodiment of the sealing ribs in the arrangement of water drainage boxes in accordance with the invention.

FIG. 6 illustrates the sealing of a chamber 31 in the water drainage box 30 against the inner face of the outer wire 10 on the forming roll 21. According to FIG. 6, ceramic wear ribs 37K are fixed permanently to the cross-direction walls of the chamber 31. This permanent fixing of the ribs 37K is denoted with the reference 39K. In FIGS. 6 and 7, the ribs 37K and 37P of the chambers 31 have been arranged at an angle b "with the fur" in relation to the inner face of the outer wire 10 so that a risk of breaking of the wires 10,20 is avoided. This means that the first end of the ribs 37K,39K in the web running direction is spaced from the wire 10 whereas the second end of the ribs 37K,39K in the web running direction is placed against the wire 10. According to FIG. 7, ceramic ribs 37P are attached to spring and/or loading elements 38*a*,38*b* by means of articulated joints 39P placed in the cross direction of the paper machine. Alternatively, the ribs 37P are mounted on the elements 38*a*,38*b* alone, in which case, by means of the elements 38*a*,38*b*, it is possible to control and, if necessary, to relieve the loading of the ribs against the inner face of the outer wire 10 in order to minimize the wear of the wire 10. The mounting of the ribs 37P can also be arranged such that the elements 38*a*,38*b* are spring-loaded elements, which press the ceramic sealing ribs 37P with a certain, suitable, if necessary, adjustable force against the inner face of the outer wire 10. Owing to the spring suspension of the sealing ribs 37P, the wear of the wire 10 can be minimized, and paper clods or fiber strings can by-pass the ribs without causing damage to the construction.

Referring again to FIG. 1, in the twin-wire portion of the former between the first forming roll 21 and the second forming roll 25, inside the wire loop 10, a formation member or forming shoe 12 is placed, which includes a dewatering/drainage element which comprises a chamber-like frame part and a deck part 13 acting against the wire 10, which deck part 13 comprises a number of ribs 13*a* separated from one another by gaps. The deck part 13 of the formation member 12 is curved either so that the curve radius R is invariable or so that the curve radius R varies continuously or with appropriate steps in the direction of progress of the wires 10,20. The position of the forming shoe 12 can be made adjustable in the vertical and horizontal directions, and its position can be rotated, for example, around an axis passing through its support points. The curve form R of the forming shoe 12 is in a direction opposite to the curve form of the sector a of the forming roll 21. For this reason, on the sector a and on the deck part 13 of the forming shoe 12, opposite directions of drainage of water can be employed, whereby the symmetry of the web formation is promoted.

Suction means such as a suction box 24 are positioned to operate on the run of the wires 10,20 between the forming rolls 21 and 25 inside the wire loop 20 after the forming member. The suction box 24 supplements the drainage of water from the web, if needed. The ultimate drainage of water taking place in the twin-wire portion is achieved on the forming roll 25, mainly on its curve sector b, after which the wires 20 and 10 are separated from one another. The web W that has been formed follows the carrying wire 20, which is guaranteed by means of a suitable vacuum effective on the sector c of the roll 25. The web W proceeds on support of the wire 20 to a point P, where it is separated from the wire 20 by means of a suction zone 50*a* of a pick-up roll 50 to be transferred onto a pick-up fabric 51 which carries the web W further into the press section of the paper machine (not shown).

At the forming shoe 12 shown in the figure, inside the inner-wire loop 20, there is a water collecting trough (not shown) in itself known, which passes the water drained through the inner wire 20 to the side of the paper machine. The guide rolls of the outer wire 10 are denoted by reference numerals 14 and 15, and the guide rolls of the inner wire 20 are denoted by reference numerals 26 and 26*a*. In the following, the operation of the former described above and its different variations will be described. In the invention, the lip plates 42*a*,42*b* guide the slice jet substantially to the bottom of the forming gap K so that drainage, in particular through the outer wire 10, does not start until in the area of the water drainage box 30 at which time, the drainage of water from the web is controlled. It is an important feature of the invention that, as stated above, on the sector a of the first forming roll 21, the drainage of water takes place under control in both directions, however generally to a greater extent through the outer wire 10. The drainage of water can also be regulated so that equal amounts of water are drained through the outer wire 10 and through the inner wire 20. In such a case, on the sector a, on the face of the outer wire 10, a relatively dense fibrous layer is couched whereas the fibrous layer at the side of the opposite wire 20 is less couched. The couched layer improves the retention and prevents washing of fine fillers through the outer wire 10. By means of the water drainage box 30 and by means of the number of successive chambers 31*a*, . . . ,31*d* possibly included in it, the dewatering pressure and its distribution on the curve sector a can always be arranged optimal in view of the paper grade that is being produced at each particular time and in view of the formation of the paper. For this reason, the curve radius of the deck 13 of the forming shoe 12 is oriented in a direction opposite to the curve radius of the sector a. In this way, by reversing the water drainage directions, an advantage is obtained in that the fibrous structure of the partly couched pulp layer is not broken, in which case a wider range is available in respect of all operating parameters.

On the sector a of the roll 21, the drainage of water is preferably restricted so that the fiber suspension is not couched completely, but it is passed onto the deck part 13 of the forming shoe 12 for the purpose of further drainage of water, on which deck the ribs 13*a* produce pulsation in the dewatering pressure. Then, water is drained primarily by the effect of forces of acceleration and by the effect of tensioning pressure ($P_r$=T/R) of the outer wire 20 in the area of the drainage/dewatering element of member 12, through the outer wire 20 and partly also through the inner wire 10, in particular if the interior of the drainage/dewatering element of member 12 communicates with suction devices, which are illustrated schematically by the block 27 in FIG. 1. The formation member 12 is followed by a suction box 24 operating against the carrying wire 20, which box can, if necessary, be used for enhancing the dewatering. In some cases, a suction box 24 is unnecessary.

On the second forming roll 25, more drainage of water still takes place by the effect of the vacuum effective on the suction zone 25. The suction zone 25*b* on the forming roll 25 is provided primarily to guarantee the separation of the web W from the covering wire 10 and further transfer of the web W on the carrying wire 20.

In the following, alternative constructions of the different elements in the former in accordance with the present invention and suitable ranges and limits of variation of the different parameters will be described.

The twin-wire water drainage zone is preferably substantially vertical. However, it should be emphasized that the invention can also be applied in formers in which the twin-wire water drainage zone is substantially horizontal, or possibly inclined or combinations of the same.

In the present invention, it is important that the first forming roll 21 drains water on a relatively narrow sector gently in two directions, mainly out of reasons related to the porosity and forming of the web W. The magnitude of the sector a is generally larger than about 10° , and, at the maximum, the sector a can be about 180° within the scope of the invention. Preferably, the magnitude of the sector a is in a range of from about 100° o about 45°. The diameter $D_0$ of the first forming roll 21 is preferably of an order of about 1.2 m or larger. After the sector a, the dry solids content $k_1$ of the pulp layer is normally about 2%, i.e., the web can by designed be dewatered in the curve sector a by the water drainage box 30 and the forming roll 21 to that dry solids content by appropriate pressure regulation of the chambers 31 in the water drainage box 30 and/or selection of the curve sector a. The curve radius $R_0$ of the guide deck 13 of the drainage/dewatering element of member 12 is in a range of about 2 m to about 8 m and preferably about 5 m. The dry solids content $k_2$ after the member 12 is about 5%, and the dry solids content $k_3$ after the second forming roll 25 is about 10%.

The examples provided above are not meant to be exclusive. Many other variations of the present invention would be obvious to those skilled in the art, and are contemplated to be within the scope of the appended claims.

We claim:

1. A twin-wire gap former in a paper machine, comprising first and second wires guided in respective loops by guide members, said first and second wires having a joint run which constitutes a twin-wire forming zone, a forming gap being defined by said first and second wires prior to said twin-wire zone, a headbox having a slice part from which a stock suspension jet is ejected into said forming gap to thereby form a web, said headbox comprising two opposed elongate lip plates extending substantially parallel to one another to define a slice channel therebetween, said slice channel extending into said forming gap and being in flow communication with said slice part of said headbox, a free end of each of said lip plates proximate said forming gap being situated proximate to or in contact with a respective one of said first and second wires, a first forming roll arranged inside the loop of said first wire and substantially directly after said forming gap in a web running direction, said twin-wire zone having a curved run about a sector of said first forming roll, water drainage means arranged inside the loop of said second wire in opposed relationship to at least a portion of said sector of said first forming roll for draining water from the web, said water drainage means comprising means defining at least one water-filled chamber and sealing means in direct contact with an inner face of said second wire for sealing said at least one chamber, and regulation means coupled to each of said at least one chamber for regulating the pressure of the water in said at least one chamber to thereby control dewatering of the web in said curved run of said twin-wire zone about said first forming roll.

2. The former of claim 1, wherein said means defining at least one chamber comprise a front wall arranged proximate to said forming gap, one of said lip plates situated closer to said second wire extending to or substantially to the vicinity of said front wall to prevent release of stock onto said second wire at a location before said at least one chamber.

3. The former of claim 1, wherein said water drainage means comprise a water drainage box extending substantially over the entire area of said curved run of said twin-wire zone about said first forming roll.

4. The former of claim 1, wherein said means defining said at least one chamber define a plurality of successively arranged chambers and said sealing means comprise cross-direction partition walls for separating said chambers from one another, said regulation means comprising a pump and a plurality of regulation valves coupled to said pump and to a respective one of said chambers such that the pressure in each of said chambers is individually controlled to thereby control the amount of water and distribution of the drainage of water taking place through said second wire.

5. The former of claim 1, wherein the magnitude of said sector of said first forming roll is in range greater than 0° and less than or equal to about 180°.

6. The former of claim 1, wherein the magnitude of said sector of said first forming roll is from about 10° to about 45°.

7. The former of claim 1, wherein said first forming roll comprises a perforated mantle having an interior, means defining at least one suction chamber in said interior of said mantle in said sector of said first forming roll about which said twin-wire zone curves, and suction regulation means for individually regulating the suction in each of said at least one suction chamber to thereby control drainage of water through said first wire.

8. The former of claim 7, wherein said means defining at least one water-filled chamber define a plurality of water-filled chambers and said means defining at least one suction chamber define a plurality of suction chambers in equal number to the number of said water-filled chambers, each of said water-filled chambers and a respective one of said suction chambers being arranged to drain water from a specific portion of said curved run of said twin-wire zone about said sector of said first forming roll.

9. The former of claim 1, wherein said first forming roll is a solid-mantle, smooth-faced forming roll, such that drainage of water on said curved run of said twin-wire zone takes place solely through said second wire.

10. The former of claim 1, wherein said means defining at least one chamber comprise at least two walls each having a respective edge proximate the inner face of said second wire, and said sealing means comprise wear ribs fixedly connected to said wall edges and contacting the inner face of said second wire.

11. The former of claim 1, wherein said means defining at least one chamber comprise at least two walls each having a respective edge proximate the inner face of said second wire, and said sealing means comprise wear ribs movably connected to said wall edges and contacting the inner face of said second wire, further comprising adjusting means coupled to each of said wear ribs for adjusting a position of said wear ribs relative to said second wire.

12. The former of claim 1, wherein said means defining at least one chamber comprise at least two walls each having a respective edge proximate the inner face of said second wire.

13. The former of claim 1, further comprising a forming shoe arranged in the loop of said first wire in said twin-wire zone after said first forming roll, said forming shoe having a curved ribbed deck for guiding said twin-wire zone in a direction of curvature opposite to the direction of curvature of said curved run of said twin-wire zone.

14. The former of claim 1, further comprising a second forming roll arranged in the loop of said first wire at an end of said twin-wire zone, said second forming roll comprising a suction roll having a suction zone for separating the web from said second wire such that the web follows said first wire.

15. The former of claim 1, further comprising a regulation control system coupled to said regulation means for controlling said regulation means, said control system receiving measurement signal/measurement signals representative of properties of the web that has been formed and controlling settings of said regulation means accordingly.

16. The former of claim 1, wherein said twin-wire zone is guided in a substantially vertical path and said forming gap is situated at a lowermost location.

17. The former of claim 1, wherein said twin-wire zone is guided in a substantially horizontal path whereby said first wire constitutes a lower wire and said second wire constitutes an upper wire, the web following said lower wire after said twin-wire zone.

18. The former of claim 13, further comprising a second forming roll arranged in the loop of said first wire at an end of said twin-wire zone, said second forming roll comprising a suction roll having a suction zone for separating the web from said second wire such that the web follows said first wire, and a flat suction box arranged in the loop of said first wire after said forming shoe and before said second forming roll.

19. The former of claim 14, wherein said twin-wire zone is guided in a substantially vertical path, said first wire constitutes a carrying wire on which the web is carried after said twin-wire zone, said first and second forming rolls being arranged substantially one above the other.

20. The former of claim 10, wherein said wear ribs are ceramic and are arranged to run with the fur of said second wire.

21. The former of claim 1, further comprising a breast roll arranged in the loop of said second wire in proximity to said first forming roll such that said breast roll guides said second wire to converge toward said first wire running over said first forming roll to thereby form said forming gap between said breast roll and said first forming roll, said water drainage means being arranged after said breast roll.

22. The former of claim 1, wherein said water drainage means are arranged entirely after said forming gap.

* * * * *